US008061432B2

(12) United States Patent
Theurer et al.

(10) Patent No.: US 8,061,432 B2
(45) Date of Patent: Nov. 22, 2011

(54) METHOD FOR REHABILITATION OF A BALLAST BED OF A TRACK

(75) Inventors: Josef Theurer, Vienna (AT); Manfred Brunninger, Altenberg (AT)

(73) Assignee: Franz Plasser Bahnbaumaschinen-Industriegesellschaft mbH, Vienna (AT)

( * ) Notice: Subject to any disclaimer, the term of this patent is extended or adjusted under 35 U.S.C. 154(b) by 0 days.

(21) Appl. No.: 12/868,145

(22) Filed: Aug. 25, 2010

(65) Prior Publication Data

US 2010/0319940 A1 Dec. 23, 2010

Related U.S. Application Data

(63) Continuation of application No. PCT/EP2009/000652, filed on Jan. 31, 2009.

(30) Foreign Application Priority Data

Feb. 26, 2008 (AT) ..... A 314/2008

(51) Int. Cl.
*E21B 27/00* (2006.01)

(52) U.S. Cl. ..... 171/16; 37/104; 104/7.3

(58) Field of Classification Search ..... 171/16; 104/7.1, 7.2, 7.3; 37/104, 105, 106, 107
See application file for complete search history.

(56) References Cited

U.S. PATENT DOCUMENTS

| | | | | |
|---|---|---|---|---|
| 3,316,666 | A * | 5/1967 | Speno | 37/107 |
| 4,450,771 | A * | 5/1984 | Theurer et al. | 104/307 |
| 4,556,112 | A * | 12/1985 | Theurer et al. | 171/16 |
| 5,090,483 | A | 2/1992 | Theurer et al. | |
| 5,090,484 | A * | 2/1992 | Theurer et al. | 171/16 |
| 5,094,018 | A * | 3/1992 | Theurer et al. | 37/104 |
| 5,479,725 | A | 1/1996 | Theurer et al. | |
| 5,513,452 | A * | 5/1996 | Theurer et al. | 37/104 |
| RE35,788 | E * | 5/1998 | Theurer et al. | 37/104 |
| 6,619,405 | B2 * | 9/2003 | Theurer et al. | 171/16 |
| 6,637,133 | B2 * | 10/2003 | Theurer et al. | 37/104 |
| 6,672,398 | B2 * | 1/2004 | Theurer et al. | 171/16 |
| 7,739,811 | B2 * | 6/2010 | Theurer et al. | 37/104 |
| 7,861,439 | B2 * | 1/2011 | Jager | 37/104 |

FOREIGN PATENT DOCUMENTS

| | | |
|---|---|---|
| EP | 0408837 A1 | 1/1991 |
| EP | 0629744 A2 | 12/1994 |

OTHER PUBLICATIONS

International Search Report dated Apr. 28, 2009.

* cited by examiner

*Primary Examiner* — Robert Pezzuto
*Assistant Examiner* — Jamie L McGowan
(74) *Attorney, Agent, or Firm* — Laurence A. Greenberg; Werner H. Stemer; Ralph E. Locher

(57) ABSTRACT

For the purpose of rehabilitation, a ballast bed of a track is taken up in the form of an upper bed layer by a first clearing device and cleaned. The bulk material accruing in the process is discharged in front of the first clearing device—with regard to the working direction—laterally upon the ballast bed in a bed region. The latter can only be covered by the second clearing device which is configured to be of greater width—with regard to a transverse direction of the track—than the first clearing device. Thus, it is possible to intermediately store bulk material, accruing in a front end region of a machine, on the ballast bed for later use.

2 Claims, 2 Drawing Sheets

METHOD FOR REHABILITATION OF A BALLAST BED OF A TRACK

CROSS-REFERENCE TO RELATED APPLICATION

This is a continuation application, under 35 U.S.C. §120, of copending international application No. PCT/EP2009/000652, filed Jan. 31, 2009, which designated the United States; this application also claims the priority, under 35 U.S.C. §119, of Austrian patent application No. A314/2008, filed Feb. 26, 2008; the prior applications are herewith incorporated by reference in their entirety.

BACKGROUND OF THE INVENTION

Field of the Invention

The invention relates to a method for rehabilitation of a ballast bed of a track, wherein an upper bed layer is taken up by a first clearing device—with regard to a working direction—and a lower bed layer adjoining the upper bed layer is taken up by a following, second clearing device.

A method of this type is known from European Pat. No. EP 0 629 744 B1, corresponding to U.S. Pat. No. 5,479,725. In this, the upper bed layer, formed of ballast, is fed into a stone crusher to produce gravel and to reuse this as a formation protection layer. The lower bed layer is disposed of entirely and replaced with new ballast.

According to European patent EP 0 408 837 B1, corresponding to U.S. Pat. No. 5,090,483, it is also known to clean ballast taken up by clearing chains arranged at the front and to discharge the ballast for intermediate storage upon the track. The intermediately stored ballast is transported across the following clearing chain by way of a special device and then discharged upon the exposed earth formation.

SUMMARY OF THE INVENTION

It is accordingly an object of the invention to provide a method for rehabilitation of a ballast bed of a track which overcomes the above-mentioned disadvantages of the prior art methods of this general type, with which a more efficient intermediate storage of bulk material is possible.

With the foregoing and other objects in view there is provided, in accordance with the invention a method for rehabilitation of a ballast bed of a track. The method includes the steps of: taking up an upper bed layer via a first clearing device—with regard to a working direction; taking up a lower bed layer adjoining the upper bed layer via a following, second clearing device; and discharging a bulk material in front of the first clearing device—with regard to the working direction—laterally upon the ballast bed in a bed region which is covered only by the second clearing device. The second clearing device has a greater width than the first clearing device with regard to a transverse direction of the track, so that the bulk material discharged is taken up together with the lower bed layer by the second clearing device.

According to the invention, the object is achieved with a method of the specified kind in that bulk material is discharged in front of the first clearing device—with regard to the working direction—laterally upon the ballast bed in a bed region which is covered only by the second clearing device, the latter being configured to be of greater width than the first clearing device with regard to a transverse direction of the track, so that the discharged bulk material is taken up together with the lower bed layer by the second clearing device.

The particular advantage resulting from this method lies in the fact that there is no need for a separate conveyor belt road to transport the bulk material back. In an advantageous manner, it is now possible to pick up the bulk material, after short-term intermediate storage, entirely by the second clearing chain without any special supporting measures. Owing to the particular lateral placement, it is furthermore possible without auxiliary devices to move the bulk material past the first clearing chain in an undisturbed manner, wherein the performance of the latter is not compromised in any way.

Other features which are considered as characteristic for the invention are set forth in the appended claims.

Although the invention is illustrated and described herein as embodied in a method for rehabilitation of a ballast bed of a track, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
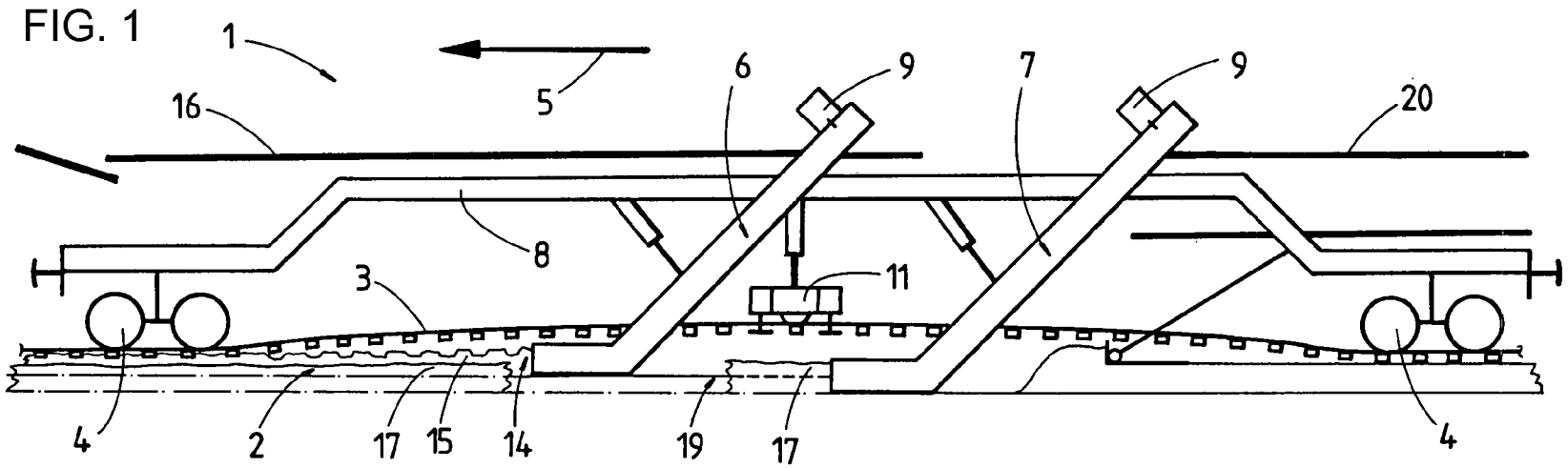
FIG. 1 is diagrammatic illustration of a machine for rehabilitation of a ballast bed according to the invention.

Referring now to the figures of the drawing in detail and first, particularly, to FIG. 1 thereof, there is shown a machine 1 that is a part of a relaying train. The relaying train is composed of several vehicles for rehabilitation of a ballast bed 2 of a track 3. A front or first clearing device 6—with regard to a working direction 5—and a following, second clearing device 7 are connected to a machine frame 8 between two on-track undercarriages 4. Each vertically and transversely adjustable clearing device 6, 7 is equipped with a drive 9 for rotation of an endless clearing chain 10 guided around the track 3 (see FIG. 3). Between the two on-track undercarriages 4, the track 3 is lifted slightly by a lifting device 11.

Figure 2:
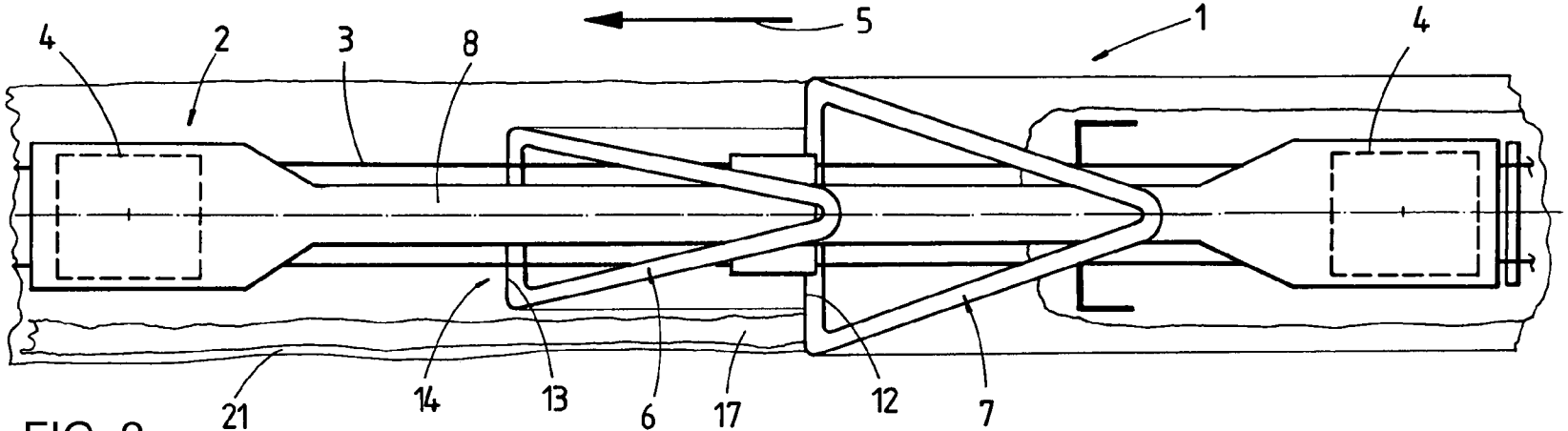
FIG. 2 is a top plan view of the machine.
Figure 3:
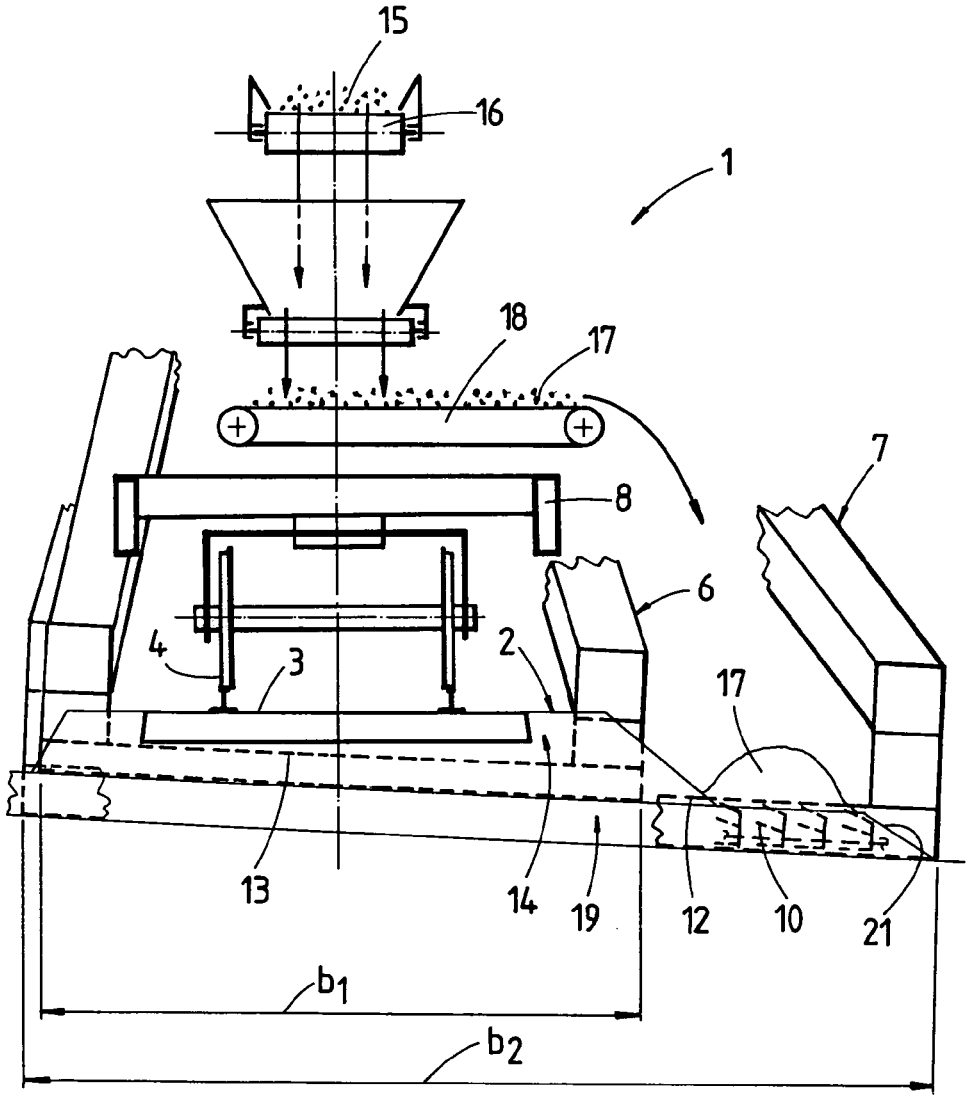
FIG. 3 is a cross-sectional view of a front end of the machine.

As can be seen in FIGS. 2 and 3, a chain portion 12—extending perpendicularly to the longitudinal direction of the track and underneath the track 3—of the second clearing device 7 is configured to be of a greater width than a corresponding chain portion 13 of the first clearing device 6.

A method for rehabilitation of the ballast bed 2 will now be described in more detail with reference to FIGS. 1 to 3.

For rehabilitation of the ballast bed 2, the machine 1 is moved continuously in the working direction 5. During this, an upper bed layer 14 formed of ballast 15 is taken up continuously by the first clearing device 6. Via a conveyor belt road 16, the picked-up ballast 15 is delivered to a screening installation, positioned at a front end of the machine and not shown in detail, and cleaned. In the process, bulk material 17 composed of small gravel and spoil is separated and discharged laterally upon the ballast bed 2 in the region of the screening installation via a transverse conveyor belt 18. The discharging takes place in a lateral section of the ballast bed 2 which is not covered by the first clearing device 6 having a width b1.

The bulk material 17, discharged for intermediate storage only in a lateral bed region 21, is finally collected, together with a lower bed layer 19, by the following second clearing device 7 having a width b2, and is discharged upon a conveyor belt 20 for further transport. The mixture, composed of small-sized grain, rubbed-off particles and earth, of the lower bed layer 19 as well as the intermediately stored bulk material 17 is mixed with aggregate and subsequently discharged upon a graded earth formation to create a formation protection layer.

The invention claimed is:

1. A method for rehabilitation of a ballast bed of a track, which comprises the steps of:

taking up an upper bed layer via a first clearing device—with regard to a working direction—with an endless clearing chain guided around the track;

taking up a lower bed layer adjoining the upper bed layer via a following, second clearing device with a further endless clearing chain guided around the track; and discharging a bulk material in front of the first clearing device—with regard to the working direction—laterally upon the ballast bed in a bed region which is covered only by the second clearing device, the second clearing device having a greater width than the first clearing device with regard to a transverse direction of the track, so that the bulk material discharged is taken up together with the lower bed layer by the second clearing device.

2. The method according to claim 1, wherein the bulk material discharged in front of the first clearing device upon the bed region is formed by spoil accruing during a cleaning of ballast.

* * * * *